United States Patent [19]

Gotoh et al.

[11] 4,336,784

[45] Jun. 29, 1982

[54] EXHAUST GAS RECIRCULATION CONTROL SYSTEM FOR ENGINES

[75] Inventors: Osamu Gotoh, Kurume; Yutaka Otobe, Niiza; Michio Kawamoto, Tokyo; Akira Fujimura, Niiza, all of Japan

[73] Assignee: Honda Giken Kogyo Kabushiki Kaisha, Tokyo, Japan

[21] Appl. No.: 194,146

[22] Filed: Oct. 6, 1980

[30] Foreign Application Priority Data

Oct. 9, 1979 [JP] Japan ..... 54-130217

[51] Int. Cl.[3] ..... F02M 25/06

[52] U.S. Cl. ..... 123/571; 123/568

[58] Field of Search ..... 123/571, 568

[56] References Cited

U.S. PATENT DOCUMENTS

| | | | |
|---|---|---|---|
| 3,282,261 | 11/1964 | Bartholomew | 123/568 |
| 3,680,318 | 8/1972 | Nakajima et al. | 60/278 |
| 3,800,766 | 4/1974 | Schubeck | 123/568 |
| 3,872,845 | 3/1975 | Schultz | 123/568 |
| 4,106,462 | 8/1978 | Yamashita et al. | 123/571 |
| 4,125,099 | 11/1978 | Nouthuka | 123/571 |
| 4,257,382 | 3/1981 | Matsui et al. | 123/571 |

*Primary Examiner*—Wendell E. Burns

*Attorney, Agent, or Firm*—Lyon & Lyon

[57] ABSTRACT

An exhaust gas recirculation control system employs a flow rate valve in the recirculation line. The valve is operated by suction pressure obtained from two suction ports in the engine intake passage. Suction lines from those ports contain air inlet valves which dilute the suction pressure with atmospheric air, depending upon engine operating conditions. A fuel supply increasing valve is connected to a venturi in the engine intake passage and suction operated control means control operation of that valve. The result is an improved acceleration characteristic for the engine under load without substantial increase in discharge of pollutants into the atmosphere.

16 Claims, 1 Drawing Figure

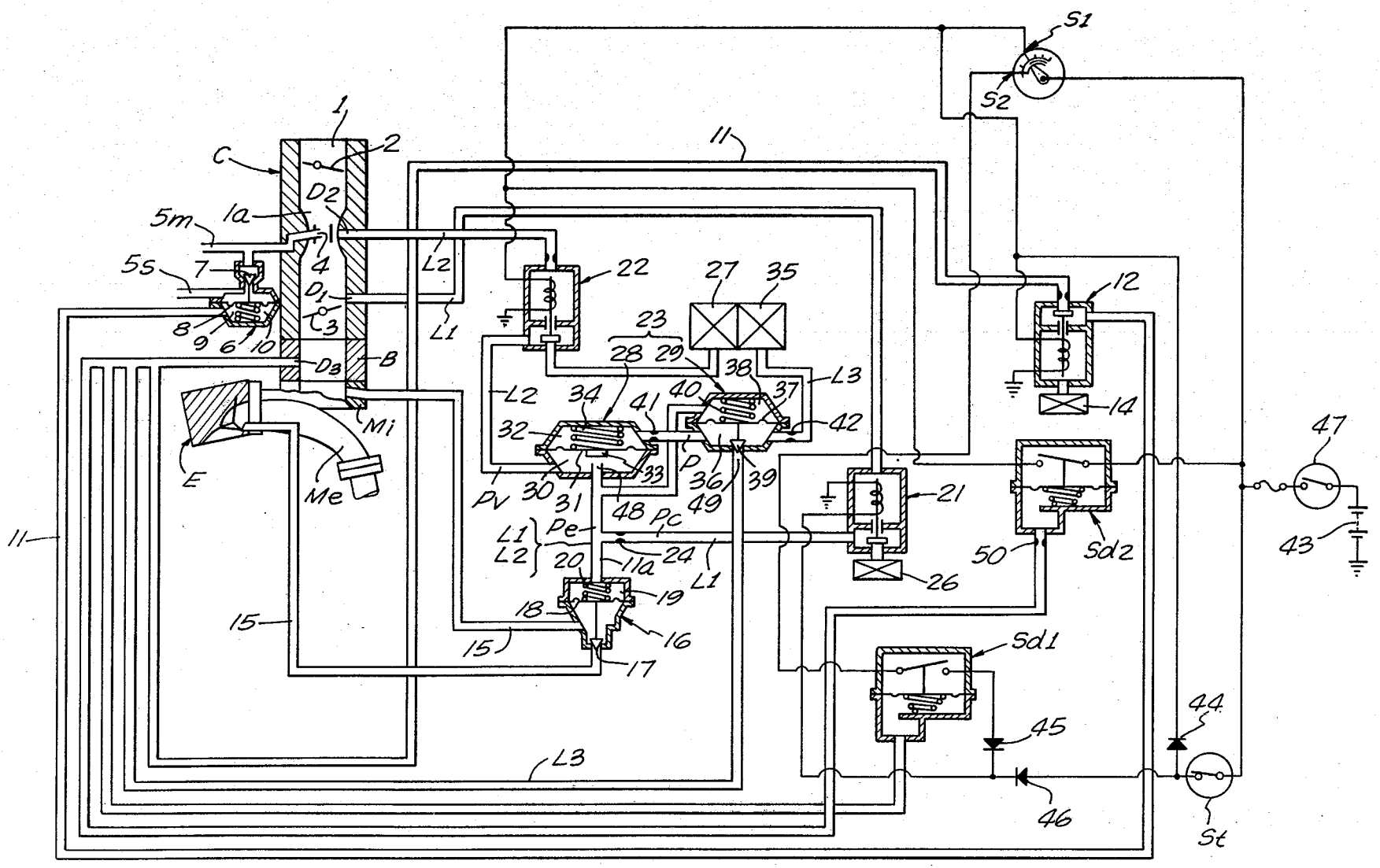
47
43
44
St
12
14
Sd2
S1
S2
50
Sd1
45
46
21
26
L3
42
35
37
39
27
38
11
36
49
40
P
L1
23
29
24
19
16
41
33
48
Pc
11a
17
22
28
34
31
Pe
20
L2
32
30
18
Pv
L1
L2
15
L3
L2
L1
2
B
Mi
1
D2
4
D1
C3
D3
Me
C
1a
10
6
7
9
8
5m
5s
E
15
11

EXHAUST GAS RECIRCULATION CONTROL SYSTEM FOR ENGINES

This invention relates to an exhaust gas recirculation control system mainly for use in vehicle engines having a flow rate control valve provided in an exhaust gas recirculation passage.

Exhaust gas recirculation systems are conventionally employed in engines which operate to return part of the exhaust gas emitted from the engine to the engine intake passage via an exhaust gas recirculation line during the operation of the engine to prevent excessive increase of the combustion temperature of the mixture in the engine cylinders. Lowering of the combustion temperature reduces the output of nitrogen oxides which are objectionable from the standpoint of atmospheric air contamination. Further, a system is also known which operates to supply the engine with a mixture having a high overall air-fuel ratio in order to reduce the concentrations of hydrocarbon, monoxide, nitrogen oxides, etc. contained in the exhaust gas. The above two systems can both the employed in engines so as to further reduce the concentration of nitrogen oxides in the exhaust gas. However, all the above-mentioned systems more or less have an unfavorable influence upon the ability of the engine to accelerate under load.

The present invention has been devised in view of the above circumstances, and it is an object of the invention to provide a system of the above-mentioned type which, during acceleration of the engine, operates to increase the quantity of fuel being delivered from the engine carburetor to compensate for insufficient engine power, and at the same time increase the flow rate of exhaust gas being returned to the engine intake passage. This has the effect of limiting increase of the combustion temperature which would be caused by the increased fuel quantity. The new system thereby contributes to both enhancement of the engine power characteristic and prevention of air contamination.

The drawing is a schematic diagram, partly in section, showing a preferred embodiment of this invention.

Referring to the drawing, the automobile engine generally designated E is provided with an intake manifold Mi and an exhaust manifold Me. A carburetor C is connected to an upstream end of the intake manifold Mi through a heat insulating barrel B.

The carburetor C includes a venturi 1*a* provided in the intake passage 1. A choke valve 2 is positioned upstream of the venturi 1*a* and a throttle valve 3 is positioned downstream of the venturi 1*a*. A fuel nozzle 4 opens into the venturi 1*a*. The intake manifold Mi and the heat insulating barrel B constitute the intake passage 1 of the engine. A first suction port D1 is located in the vicinity of or downstream from the throttle valve 3, and a second suction port D2 opens into the venturi 1*a*. A third suction port D2 opens into the venturi 1*a*. A third suction port D3 is positioned at a location downstream of the throttle valve 3.

A fuel passage leading to the fuel nozzle 4 comprises a main fuel passage 5*m* and an auxiliary fuel passage 5*s*, both of which communicate with a float chamber, not shown, in which float chamber the passages 5*m* and 5*s* open below the fuel surface level. The auxiliary fuel passage 5*s* is provided with a fuel supply increasing valve 6. The valve 6 includes a movable valve element 7 arranged to open or close the auxiliary fuel passage 5*s*. The valve 6 also includes a diaphragm 8 connected to the valve element 7, and a valve spring 10 positioned within the suction pressure chamber 9 below the valve element 7. The spring 10 urges the valve element 7 in the valve-opening direction.

The suction chamber 9 of the fuel supply increasing valve 6 communicates with the third suction port D3 via a suction passage 11 in which a solenoid-type stop valve 12 is provided. This stop valve 12 operates to open the suction passage 11 when its solenoid is energized, and closes the same passage 11 and simultaneously connects the downstream side of the passage 11 with an air intake port 14 provided with a filter, when the solenoid is de-energized. Accordingly, the fuel supply increasing valve 6 is kept open to cause an increase in the quantity of fuel being injected through the fuel nozzle 4 when the valve 12 is de-activated, or when the valve 12 is activated while the suction pressure at the third suction port D3 is below a predetermined value. When the suction pressure at port D3 exceeds the predetermined value, the fuel supply increasing valve 6 is closed by activation of the stop valve 12 to interrupt the fuel increasing action. Control of the activation of the stop valve 12 is described below.

An exhaust gas recirculation conduit 15 extends from an exhaust port of the engine E and communicates with the intake manifold Mi, with a flow rate control valve 16 provided in the conduit 15. Valve 16 includes a movable valve element 17 operated by a diaphragm 18. A valve spring 20 is positioned within the suction chamber 19 formed above the diaphragm 18 and acts to urge the valve element 17 toward closed position.

The first suction line L1 extends from the suction port D1 through the solenoid-operated air valve 21 to the suction chamber 19 of the recirculation control valve 16. An orifice 24 is located downstream of the valve 21 in the suction line L1. A second suction line L2 extends from the suction port D2 to the suction chamber 19 by way of solenoid-operated air valve 22 and the regulating valve 28. The air valves 21 and 22 each operate to close the upstream side of their respective suction lines L1 and L2, and simultaneously allow the downstream sides to communicate respectively with air intake ports 26 and 27 provided with filters, when their solenoids are energized.

The control valve generally designated 23 includes a suction pressure responsive-type regulating valve 28 arranged to open or close the second suction line L2, and also includes an air valve 29 of the suction pressure responsive-type adapted to adjust the suction pressure acting upon the regulating valve 28. The regulating valve 28 includes a valve chamber 30 connected to the second suction line L2 and also includes a suction chamber 32 separated from the valve chamber 30 by the diaphragm 31. A flat movable valve element 33 fixed to the diaphragm 31 opens and closes with respect to a valve port 48 at the open end of the line 11*a* extending between the regulating valve 28 and the recirculation control valve 16. A valve spring 20 urges the valve element 17 toward its closed position.

The air valve 29 is comprised of a valve chamber 36 positioned in a third suction line L3 extending from the third suction port D3 and leading to an air intake port 35 provided with a filter. A suction chamber 38 is separated from the valve chamber 36 by the diaphragm 37. A movable valve element 39 secured on the diaphragm 37 is positioned to vary the opening of a valve port 49 formed at the open end of the third suction line L3. A valve spring 40 is arranged to urge the valve element 39 in its closing direction. The valve element 39 of this valve 29 has a configuration similar to that of the valve element 17 of the aforementioned flow rate control valve 16. The suction chamber 38 communicates with the first suction line L1 located downstream of the regulating valve 28, while the valve chamber 36 communicates with the pressure chamber 32 via an orifice 41. Another orifice 42 is provided at a location between the valve chamber 36 and the air intake port 35.

In the present specification, the terms "upstream side" and "downstream side" of the suction lines mean "suction pressure supply source side" and "air intake port side", respectively.

When the solenoid-type stop valves 21, 22 are deactivated, the suction pressure control valve 23 operates as follows:

A suction pressure is produced in the vicinity of the throttle valve 3 or at a location downstream of same as the engine E operates, and is detected as negative pressure Pc at the first suction pressure port D1. The suction pressure Pc is transmitted to the chamber 38 of the air valve 29 via the stop valve 21 and the orifice 24, so that when the suction pressure Pc overcomes the setting load of the valve spring 40, it lifts the valve element 39 together with the diaphragm 37 to open the third suction pressure line L3.

When the third suction pressure line L3 is thus opened, atmospheric air is introduced into the third suction line L3 via the intake port 35 and then into the intake passage 1 of the engine E. As a consequence, suction pressure P produced in the valve chamber 36 of the air valve 29 is transmitted to the suction chamber 32 of the regulating valve 28. When the difference between the suction pressure P and the suction pressure Pv, at the second suction port D2, overcomes the setting load of the valve spring 34, the valve element 33 is lifted together with the diaphragm 31 to open the valve port 48. Part of the suction pressure Pv escapes through the valve port 48 to dilute or reduce the intensity of the suction pressure which has previously passed the orifice 24 into suction pressure Pe in line 11*a*. This suction pressure Pe serves as actuating pressure for the flow rate control valve 16.

Due to the above dilution or reduction of intensity in the suction pressure, the suction pressure present in the chamber 38 is reduced, and accordingly the opening of the air valve 29 is reduced which results in a corresponding decrease in the suction pressure in the valve chamber 36. The suction pressure in the chamber 32 of the regulating valve 28 also decreases so that the valve element 33 closes the valve port 48. Then, the suction pressure Pe increases. This cycle of operation is repeated. Since this repetition occurs very quickly, the quantity of air travelling in the third suction passage L3 becomes proportional to the quantity of air being sucked into the engine E so that the suction pressure P has a value approximate to that of the suction pressure Pv.

Thus, when the quantity of air being sucked into the engine E is small, the suction pressure P is higher than the suction pressure Pv and accordingly the valve element 33 of the regulating valve 28 is displaced in its open position to decrease the actuating pressure Pe for the flow rate control valve 28. On the other hand, when the quantity of suction air increases, the suction pressure Pv increases so that the valve element 33 is displaced into its closing position to increase the actuating pressure Pe. In this manner, the air valve 29 and the flow rate control valve 16 are actuated by the same suction pressure Pe. Further, their respective valve elements 39, 17 are similar in configuration to each other. Therefore, the quantity of air flowing in the third suction pressure passage L3, that is, the quantity of air being sucked into the engine E, is proportional to the quantity of exhaust gas being returned to the suction passage so that the engine E can be supplied with exhaust gas at a permanently constant return ratio.

On the other hand, when the stop valve 22 is activated to block the upstream side of the second suction pressure line L2 and simultaneously allow the downstream side of same to communicate with the air intake port 27, the regulating valve 28 has its valve chamber 30 supplied with atmospheric pressure which displaces the valve element 33 into its open position so that the actuating suction pressure Pe decreases. This reduces the opening of the flow rate control valve 16, resulting in a decrease in the flow rate of exhaust gas being recirculated.

When the other stop valve 21 is activated to block the upstream side of the first suction line L1 and simultaneously allow the downstream side of same to communicate with the air intake port 26, the actuating suction pressure Pe is replaced by atmospheric pressure to bring the flow rate control valve 16 into its closed position, resulting in interruption of the recirculation of exhaust gas.

The control system for the above-mentioned solenoid-type stop valves 12, 21, 22 will now be described. The control system is mainly comprised of first and second vehicle speed sensing switches S1, S2, an engine temperature sensing switch St, and first and second vacuum pressure detecting switches Sd1, Sd2. The switch S1 closes when the vehicle speed is high (e.g., 45 km/h or more), the switch S2 opens when the vehicle speed is low (e.g., 20 km/h or less), the switch St detects the temperature of engine cooling water as engine temperature and closes when the temperature is low (e.g., 60° C. or less), and the switch Sd1 closes when the suction pressure detected by the third suction port D3 exceeds a predetermined value (e.g., 500 mm Hg), and the switch Sd2 closes when said suction pressure exceeds another predetermined value (e.g., 350 mm Hg). The suction line leading to the switch Sd2 is provided therein with an orifice 50 which acts to slightly delay the actuating timing of the switch Sd2 with respect to the actuating timing of the switch Sd1.

The stop valves 12 and 22 have their solenoids connected in parallel to a power source or battery 43 via the first vehicle speed sensing switch S1. These solenoids are also connected to the power source 43 via the second vacuum pressure sensing switch Sd2. Also, the stop valve 12 has its solenoid connected to the power source 43 via the engine temperature sensing switch St and a diode 44. The stop valve 21 has its solenoid connected to the power source 43 via the first vehicle speed sensing switch S1, the first vacuum pressure sensing switch Sd1 and a diode 45, and also via the engine temperature sensing switch St and a diode 46. Reference numeral 47 designates the ignition switch of the engine.

The operation of the control system with the above arrangement will now be described.

During Cold State of the Engine

In this state, the engine temperature sensing switch St is on to activate the stop valve 12 so that the fuel supply increasing valve 6 has its chamber 9 supplied with suction pressure from the third suction port D3. As this suction pressure decreases, that is, as the engine load increases, the valve element 7 is displaced so as to increase the quantity of fuel injected through the fuel nozzle 4.

When the switch St is thus on, the stop valve 21 is also activated and accordingly the flow rate control valve 16 is kept in its closed position, and exhaust gas recirculation is not carried out, since the actuating suction pressure Pe is replaced by atmospheric pressure. This interruption of exhaust gas recirculation is effected for the reason that when the engine E is in a cold state, nitrogen oxides are not produced in appreciable quantities due to low combustion temperature of the mixture, even in the absence of exhaust gas recirculation.

During Warmed-up State of the Engine (But Not During Deceleration)

A. In low or medium vehicle speed ranges (e.g., 45 km/h or less) and when engine load is relatively high (e.g., vacuum pressure in the intake passage is below 350 mm Hg):

In this state, the engine temperature sensing switch St, the first vehicle speed sensing switch S1 and the second vacuum pressure sensing switch Sd2 are all in the off position, and accordingly the solenoid valves 12, 21 and 22 are all de-activated. Since the suction pressure chamber 9 of the fuel supply increasing valve 6 is supplied with atmospheric pressure via the air intake port 14 during de-activation of the valve 12, as previously mentioned, the valve element 7 is displaced to its maximum opening position so that the rate at which fuel is injected through the fuel nozzle 4 is increased. Therefore, the engine power can be increased when the vehicle is operated at a low or medium speed as well as at a high load, thus improving acceleration. Particularly, the present system can be advantageously applied to an engine operating on a lean mixture.

On the other hand, when the stop valves 21, 22 are de-activated, the first and second suction pressure lines L1, L2 are both held open so that, as previously mentioned, the flow rate control valve 16 has its opening regulated to a value appropriate for the quantity of suction air supplied to the engine. This is caused by the action of the actuating suction pressure Pe which is controlled by the suction pressure control valve 23, resulting in supply of exhaust gas into the suction passage through the exhaust gas recirculation passage 15 at a required and sufficient flow rate. Thus, the production of unwanted nitrogen oxides due to the elevated engine power can be effectively restrained.

B. In a high vehicle speed range (e.g., 45 km/h or more):

In this speed range, the first vehicle speed sensing switch S1 closes, with the stop valves 12 and 22 in an activated state so that the fuel increasing valve 6 has its suction pressure chamber 9 supplied with suction pressure from the third suction port D3 to weaken its fuel quantity increasing function. At the same time, the suction pressure control valve 23 acts to reduce the actuating suction pressure Pe so that the flow rate control valve 16 has its opening reduced to correspondingly reduce the flow rate of recirculating exhaust gas. In this manner, the fuel consumption rate can be reduced while maintaining a satisfactory level of engine power.

During Deceleration of the Engine

By the time the vehicle comes into high speed operation, the second vehicle speed sensing switch S2 is closed. If the vehicle in this state is decelerated (engine braking effect), suction pressure (e.g., 500 mm Hg) is produced in a zone downstream of the throttle valve 3 which is higher than that produced during idling. The switches Sd1 and Sd2 close in response to this high negative pressure. Since the stop valves 21, 22 are activated when the switches S2, Sd1, Sd2 are closed, the flow rate control valve 16 is closed to interrupt the exhaust gas recirculation. This interruption is effected for the reason that the rate of production of nitrogen oxides is small during deceleration of the engine and that the quantity of unburned gas components in the exhaust gas should desirably be kept as small as possible.

When the switch Sd2 is closed, the stop valve 12 is also activated so that the suction pressure chamber 9 of the fuel supply increasing valve 6 is supplied with high suction pressure from the third suction port D3, via the stop valve 12, to close the valve 6, thus interrupting the fuel quantity increasing action.

Then, when the vehicle speed decreases to a predetermined low range, e.g., 20 km/h or less, the second vehicle speed sensing switch S2 opens to de-activate the stop valve 21 and accordingly the flow rate control valve 16 again opens to the proper degree.

As set forth above, according to the present invention, first and second suction pressure lines are connected to a suction pressure chamber provided in a flow rate control valve for controlling the flow rate of exhaust gas being returned to the intake passage of the engine. The first and second suction pressure lines extend, respectively, from a first suction port provided in the vicinity of a throttle valve of the carburetor or in a zone downstream of the throttle valve, and from a second suction port provided at a venturi of the carburetor. A suction pressure control valve is provided in the second suction pressure line for controlling the degree of dilution of suction pressure at the first suction port by admixture with the suction pressure at the second suction port. Further, a stop valve is provided between the suction pressure control valve and the second suction port, for acting in response to the action of a control valve for regulating the fuel quantity increasing action of a fuel supply increasing valve provided in the carburetor. The effect is to overcome the suction pressure at the second suction port when the fuel quantity increasing action declines.

With the above arrangement, when the fuel quantity increasing action is strengthened to compensate for insufficient engine power, recirculation of exhaust gas can be effected at a sufficient flow rate to achieve satisfactory enhancement of the engine power and minimize air contamination at the same time. Further, when the fuel quantity increasing action declines or ceases, the flow rate of exhaust gas being returned can be reduced to a moderate extent, to thereby avoid an unnecessary drop in the engine power.

Having fully described our invention, it is to be understood that we are not to be limited to the details herein set forth but that our invention is of the full scope of the appended claims.

We claim:

1. An exhaust gas recirculation control system for an engine applied to a vehicle, the engine having an intake passage with an auxiliary fuel supply means, and having a recirculation control valve provided in an exhaust gas recirculation line which extends from an exhaust passage of the engine and leads to the intake passage, the control system comprising, in combination: an expansible chamber provided in said recirculation control valve, a first suction line extending from a first suction port provided in the vicinity of a throttle valve in said intake passage to said expansible chamber, a second suction line extending from a second suction port provided at a venturi in said intake passage, pressure control valve means operatively connected to said suction lines for controlling the intensity of suction pressure from said first suction port, a first control valve means provided in said second suction line, a second control valve means provided for controlling said auxiliary fuel supply means to vary the rate of supply of auxiliary fuel, said first and second control valve means operating cooperatively in response to an operating condition of said engine or vehicle.

2. The exhaust gas recirculation control system for an engine as recited in claim 1, wherein said pressure control valve means comprises: a regulating valve including a valve chamber operatively positioned in said second suction line, a suction chamber formed adjacent to said valve chamber with a diaphragm intervening therebetween, a connecting line extending between said expansible chamber and said valve chamber of the regulating valve, and a valve element secured to said diaphragm for opening or closing an open end of said connecting line, an air valve including a valve chamber operatively positioned in a third suction line, said valve chamber communicating with said suction chamber of the regulating valve, a suction chamber formed adjacent to said valve chamber with a diaphragm intervening therebetween, said suction chamber communicating with the expansible chamber of said recirculation control valve, and a valve element secured to said diaphragm of the air valve for opening or closing the upstream side of said third suction line, and an orifice provided between said air valve and the air intake port of said third suction line.

3. An exhaust gas recirculation control system for an engine having an exhaust gas recirculation conduit extending from an exhaust gas passage from the engine to the intake passage of the engine, together with a valve in the recirculation passage, the system comprising, in combination: suction pressure means including an expansible chamber for operating the recirculation valve, a regulating valve having a diaphragm separating a suction chamber from a regulating chamber, a connecting line extending between said expansible chamber and the regulating chamber of said regulating valve, a valve element movable with said diaphragm to open and close an open end of said connecting line, a first suction line extending from a first suction port in the engine intake passage and located in the vicinity of a throttle valve therein, said first suction line extending to said connecting line, a second suction line extending from a second suction port at a venturi in the intake passage to the regulating chamber in the regulating valve, a control valve having a diaphragm separating a valve chamber from a suction chamber, a conduit connecting the valve chamber of the control valve to the suction chamber of the regulating valve, a second conduit connecting said suction chamber of the control valve to said expansible chamber, a third suction line extending from a third suction port in the intake passage downstream from the throttle valve to atmosphere by way of said valve chamber of the control valve, a second valve element movable with said diaphragm of the control valve to open and close said third suction line, a fuel passage communicating with said venturi, a fuel supply increasing valve connected to said passage, and means responsive to engine load for controlling operation of said fuel supply increasing valve.

4. The control system of claim 3 in which a temperature-responsive valve is provided in said first suction line and acts to close that line and introduce atmospheric air into said connecting line when the temperature of the engine coolant falls below a predetermined level.

5. The control system of claim 3 in which said means responsive to engine load includes a vacuum pressure sensing electric switch responsive to intake vacuum pressure downstream from the throttle valve in the intake passage, and an electric magnet switch provided in a vacuum pressure conduit leading from the third suction line to the fuel supply increasing valve, said electric switches being connected in series to a power source.

6. The control system of claim 3 in which a vehicle speed-responsive valve is provided in said second suction line and acts to close that line and to introduce atmospheric air into said regulating chamber when the vehicle speed extends a predetermined rate.

7. The control system of claim 6 in which said vehicle speed-responsive valve is an electric magnet switch connected to a speedometer and also connected to a vacuum pressure sensing electric switch.

8. The control system of claim 7 in which said electric magnet switch is connected to a power source by way of a thermo-switch which opens below a predetermined temperature of the engine coolant.

9. The control system of claim 5 in which said electric magnet switch is connected to a speedometer and acts to close that conduit when the vehicle speed extends a predetermined rate.

10. The control system of claim 5 in which said electric magnet switch is connected to a power source by way of a thermo-switch which opens below a predetermined temperature of the engine coolant.

11. An exhaust gas recirculation control system for an engine applied to a vehicle, the engine having an intake passage with an auxiliary fuel supply means, and having a recirculation control valve provided in an exhaust gas recirculation line which extends from an exhaust passage of the engine and leads to the intake passage, the control system comprising, in combination: regulating control valve means for controlling the recirculation control valve, first control valve means for controlling the regulating control valve to vary the flow rate of exhaust gas recirculation through the recirculation control valve, second control valve means for controlling the auxiliary fuel supply means to vary the supply of auxiliary fuel, the first and second control valve means operating cooperatively responsive to an operating condition of the engine or the vehicle, whereby said recirculation control valve and said auxiliary fuel supply means are controlled in a manner such that the flow rate of exhaust gas being recirculated and the rate of supply of auxiliary fuel to the engine are varied in response to the operating condition of the engine or vehicle.

12. The control system of claim 11 in which said operating condition of said engine or vehicle is one or more of high temperature of engine cooling water, low vehicle speed, and low intake vacuum pressure.

13. An exhaust gas recirculation control system for an engine applied to a vehicle, the engine having an intake passage with an auxiliary fuel supply means, and having a recirculation control valve provided in an exhaust gas recirculation line which extends from an exhaust passage of the engine and leads to the intake passage, the control system comprising, in combination: a pressure control valve means for controlling suction pressure introduced from the intake passage into the recirculation control valve, the recirculation control valve being responsive to suction pressure in the intake passage, first control valve means for controlling the pressure control valve means to vary the flow rate of exhaust gas through the recirculation control valve, second control valve means for controlling the auxiliary fuel supply means to vary the rate of supply of auxiliary fuel, the first and second control valve means operating cooperatively responsive to an operating condition of the engine or the vehicle, whereby said recirculation control valve and said auxiliary fuel supply means are controlled in a manner such that the flow rate of exhaust gas being recirculated and the quantity of auxiliary fuel being supplied to the engine are varied in response to the operating condition of the engine or vehicle.

14. The control system of claim 13 in which said operating condition of the engine or the vehicle is one or more of high temperature of engine cooling water, low vehicle speed, and low intake vacuum pressure.

15. An exhaust gas recirculation control system for an engine applied to a vehicle, the engine having an intake passage with an auxiliary fuel supply means, and having a recirculation control valve provided in an exhaust gas recirculation line which extends from an exhaust passage of the engine and leads to the intake passage, the control system comprising, in combination: an expansible chamber provided in said recirculation control valve, a first suction line extending from a first suction port provided in the vicinity of a throttle valve in said intake passage to said expansible chamber, a second suction line extending from a second suction port provided at a venturi in said intake passage, pressure control valve means operatively connected to said suction lines for controlling the degree of dilution of suction pressure from said first suction port by admixture with suction pressure from said second suction port, a first control valve means provided in said second suction line, a second control valve means for controlling said auxiliary fuel supply means, said first and second control valve means operating cooperatively responsive to an operating condition of said engine or vehicle, whereby said recirculation control valve and said auxiliary fuel supply means are controlled in a manner such that the flow rate of the exhaust gas being recirculated and the rate of supply of auxiliary fuel to said engine are varied in response to the operating condition of the engine or vehicle.

16. The control system of claim 15 in which said pressure control valve means comprises: a regulating valve including a valve chamber operatively positioned in said second suction line, a suction chamber formed adjacent to said valve chamber with a diaphragm intervening therebetween, a connection line extending between said expansible chamber and the valve chamber of said regulating valve, and a valve element secured to said diaphragm for opening or closing an open end of said connecting line, an air valve including a valve chamber operatively positioned in a third suction line, said valve chamber communicating with said suction chamber of the regulating valve, a suction chamber formed adjacent to said valve chamber of the air valve with a diaphragm intervening therebetween, said suction chamber of the air valve communicating with the expansible chamber of said recirculation control valve, and a valve element secured to said diaphragm of the air valve for opening or closing the upstream side of said third suction line, and an orifice provided between said air valve and the air intake port of said third suction line.

* * * * *